US009715842B2

(12) United States Patent
Mileski

(10) Patent No.: US 9,715,842 B2
(45) Date of Patent: Jul. 25, 2017

(54) SELF TENSIONING MOUNTING FRAME FOR SHEET MEDIA

(71) Applicant: Bret Mileski, Lake Elsinore, CA (US)

(72) Inventor: Bret Mileski, Lake Elsinore, CA (US)

( * ) Notice: Subject to any disclaimer, the term of this patent is extended or adjusted under 35 U.S.C. 154(b) by 89 days.

(21) Appl. No.: 14/606,887

(22) Filed: Jan. 27, 2015

(65) Prior Publication Data

US 2015/0213740 A1 Jul. 30, 2015

Related U.S. Application Data

(60) Provisional application No. 61/931,905, filed on Jan. 27, 2014.

(51) Int. Cl.
*G09F 15/00* (2006.01)
*G09F 7/18* (2006.01)

(52) U.S. Cl.
CPC ..... *G09F 15/00* (2013.01); *G09F 15/0025* (2013.01); *G09F 2007/1843* (2013.01); *G09F 2007/1886* (2013.01); *G09F 2015/0093* (2013.01)

(58) Field of Classification Search
CPC ..... G09F 15/0025; G09F 2007/1843; G09F 2007/1886; G09F 2015/0093
USPC ..... 40/603, 611.12, 607.14
See application file for complete search history.

(56) References Cited

U.S. PATENT DOCUMENTS 4,265,039 A 5/1981 Brooks
4,769,877 A * 9/1988 Conley ..... A01G 9/1415 160/392
4,959,916 A 10/1990 Cochrane et al.
5,142,804 A 9/1992 Hillstrom et al.
6,339,889 B1 1/2002 Griesemer et al.
6,865,836 B2 3/2005 Sachs-Lavery
7,178,281 B2 * 2/2007 Johansson ..... G09F 15/0025 38/102.91
7,260,908 B2 * 8/2007 Devaney ..... G09F 15/0025 40/590
8,595,966 B2 12/2013 Breihof
2004/0128894 A1 * 7/2004 Sachs-Lavery ..... A47G 1/08 40/741
2005/0235585 A1 10/2005 Green et al.
2007/0044359 A1 3/2007 Worley
2008/0148615 A1 6/2008 Mileski
2010/0257767 A1 * 10/2010 Markoff ..... G09F 15/0018 40/606.1
2011/0258897 A1 10/2011 Dorsey

* cited by examiner

*Primary Examiner* — Kristina N Junge
(74) *Attorney, Agent, or Firm* — Kenneth Avila

(57) ABSTRACT

A media frame assembly for displaying a sheet of media against a mounting surface comprising a base plate and a cover plate. The base plate has multiple features so as to minimize contact with the mounting surface, space for rivet nuts, adhesive strip to secure media prior to mating with cover plate, and a channel and groove to mate with legs and protrusion from cover plate. The cover plate has multiple features so as to mate with base plate, simplify installation, and legs and protrusion to mate with channel and groove located in the base plate. The channel and groove located in the base plate operate in conjunction with legs and protrusion in cover plate to provide some tensioning of the media when the cover plate is mated to the base plate.

5 Claims, 5 Drawing Sheets

SELF TENSIONING MOUNTING FRAME FOR SHEET MEDIA

CROSS-REFERENCE TO RELATED APPLICATIONS

This application claims the benefit of U.S. Provisional Application No. 61/931,905 filed Jan. 27, 2014, which is incorporated herein by reference in its entirety.

BACKGROUND OF THE INVENTION

1. Field of the Invention

The present invention relates generally to media display systems, and, more particularly, to media frame assemblies, systems, and methods for displaying various types of media, in sheet form, on one or more surfaces in a quick, economical, and effective manner.

2. Description of the Related Art

Advertisements using sheet media displayed to the public are frequently used to attract the public's attention When used on automobiles, buildings, appliances, and other billboards including mobile and stationary billboards. Furthermore, many companies have promotions that are short in duration Which leads to the need for an easy and efficient way to replace advertising medium on those display surfaces. Some attempts have been made to hold sheet media in framing systems.

In one example, U.S. Publication No. 20050235585 discloses a framing system for mounting sheet media. The framing system includes U-shaped channels, or lineals, having at least one external built-in groove for receiving a spline strip for holding an edge of the sheet media in place in the groove. A rectangular opening is defined by four lineals over which the sheet media is stretched and then secured in place by jamming its edges into the external spline grooves of the surrounding four lineals with the spline strips thereby holding the sheet in place. The lineals are held to the porch walls by universal fasteners. This framing system is not easy for installations in view of its configurational complexity.

In another example, U.S. Publication No. 20040128894 discloses a framing system for framing artwork, drawings, pictures and mounting the framed work on a surface. The framing system includes at least one frame member cooperating with a plurality of mounting elements to surround the work with the frame member(s) and mount the resultant framed work to a mounting surface. Each mounting element comprises a magnetic material and an adhesive material. The adhesive material is used to mount the resulting framed work to the surface by an adhesive bond between the mounting elements and the surface. The framing system provided herein does not allow for a greater tolerance in terms of margin of error for the installer and user thereby does not provide for a greater flexibility in terms of usage.

Next, U.S. Pat. No. 5,142,804 discloses an anchoring apparatus for anchoring and tensioning a sheet media on a panel structure, such as a billboard. The anchoring apparatus comprises of a preferred channel-shaped base member secured to the rear of the panel structure and includes a clip member slidably interconnected with the base member. This anchoring apparatus is complex in configuration and does not provide for an effective framing system capable of meeting the needs of the installer.

In U.S. Pat. No. 7,260,908 a system and method for forming sheet tabs for attaching sheet media on support structures, such as trucks, buildings, and billboards is disclosed. However this system requires that (i) the sheet media to be frame have retaining members stitched into the top and bottom edges of the sheet media, (ii) the frame assembly be mounted to the support structure in nearly the same dimensions as the sheet media, and (iii) the sheet media is only supported at the top and bottom, not along the left and right sides. Moreover the disclosed frame assembly has multiple pieces that must be fitted together resulting in greater installation time.

Similar to the '908 patent is U.S. Pat. No. 7,178,281 which discloses a system for mounting fabric signs. Although simpler to assemble and does allow the frame assembly to function as a visible border it still contains the disadvantages of requiring that (i) the sheet media to be frame have retaining members folded into the top and bottom edges of the sheet media, and (ii) the sheet media is only supported at the top and bottom, not along the left and right sides. In addition it has the distinct disadvantage that the frame assembly be mounted in exactly the same dimensions as the sheet media to be mounted. If the frames are mounted slightly too close together the sheet media will not be taut. Mount the frames slightly too far apart and the frames will have to be remounted.

In light of the above, it is an object of the present invention to provide a system whereby the number of pieces that comprise the frame is at most two in order to simplify the assembly and mounting of sheet media.

It is another object of the present invention to provide a system whereby the sheet media will not require any retaining members to be added to the edges of the sheet media.

It is another object of the present invention to provide a system whereby the frame to mount the sheet media must be at most the same dimensions as the sheet media and if the sheet media needs to be cropped in order to fit within an allowable space for a particular surface the frame may be easily resized and provide a cutting guide to trim any excess sheet media.

It is still another object of the present invention to provide a system that during the assembly process will provide a certain amount of self tensioning.

It is another object of the present invention to minimize the area of contact between the frame and the surface where it is to be mounted yet provide at least two different points of contact so as to accommodate surfaces with varying features present on the surface.

It is another object of the present invention to form the profile of the frame so as to allow for the usage of rivet nuts to increase the number of times different sheet media may be mounted onto the same frame.

Finally it is another object of the present invention to provide small channels on the frame to be used as guides for drilling machine screws and minimize any drifting of the machine screw during drilling.

SUMMARY OF THE INVENTION

The preferred embodiment of the present invention includes a frame assembly for displaying sheet media against a surface comprising a base plate configured to be attached to the surface, a cover plate running upon the base plate across the length of the base plate, the cover plate having a curve like contour at one end across the length thereof capable of engaging with the base plate so that the sheet media is sandwiched and held between the base plate and the cover plate. Both the base plate and the cover plate are of unibody design using lightweight metallic alloys and fabricated using an extrusion process.

The base plate will make three points of contact with the mounting surface. One point of contact will be of sufficient width to deploy various types of fasteners while the remaining two points of contact will only be of width sufficient to prevent the collapse of the base plate onto the mounting surface. Additionally the point of contact wherein various types of fasteners are deployed will contain a small channel etched into the surface to assist the installer in locating the appropriate location to drill a fastener when attaching the base plate to the mounting surface and to prevent the fastener from drifting during drilling. Finally the point of contact wherein various types of fasteners are deployed will contain a plurality of holes, periodically located, so that the base plate may be used as a template for marking the position of fasteners on the mounting surface.

Additionally the base plate will have a 'V' groove designed to mate with a 'V' protrusion on the cover plate so as to enhance the self tensioning aspect of the frame when the base plate and cover plate come together during the assembly process. This feature will work in conjunction with two legs protruding from the cover plate designed to mate with a channel in the base plate so as to tuck the sheet media within the channel of the base plate and tension it.

Finally the base plate and cover plate of the present invention both have profiles consisting of multiple segments of varying widths and angles in order to increase the structural integrity of the frame and to provide space within the frame for the use of rivet nuts or other such devices when attaching the base plate to the mounting surface or the cover plate to the base plate.

These together with other aspects of the present invention, along with the various features of novelty that characterize the invention, are pointed out with particularity. For a better understanding of the invention, its operating advantages and the specific objects attained by its uses, reference should be had to the accompanying drawings and descriptive matter in which there are illustrated exemplary embodiments of the present invention.

DETAILED DESCRIPTION OF THE INVENTION

Figure 1:
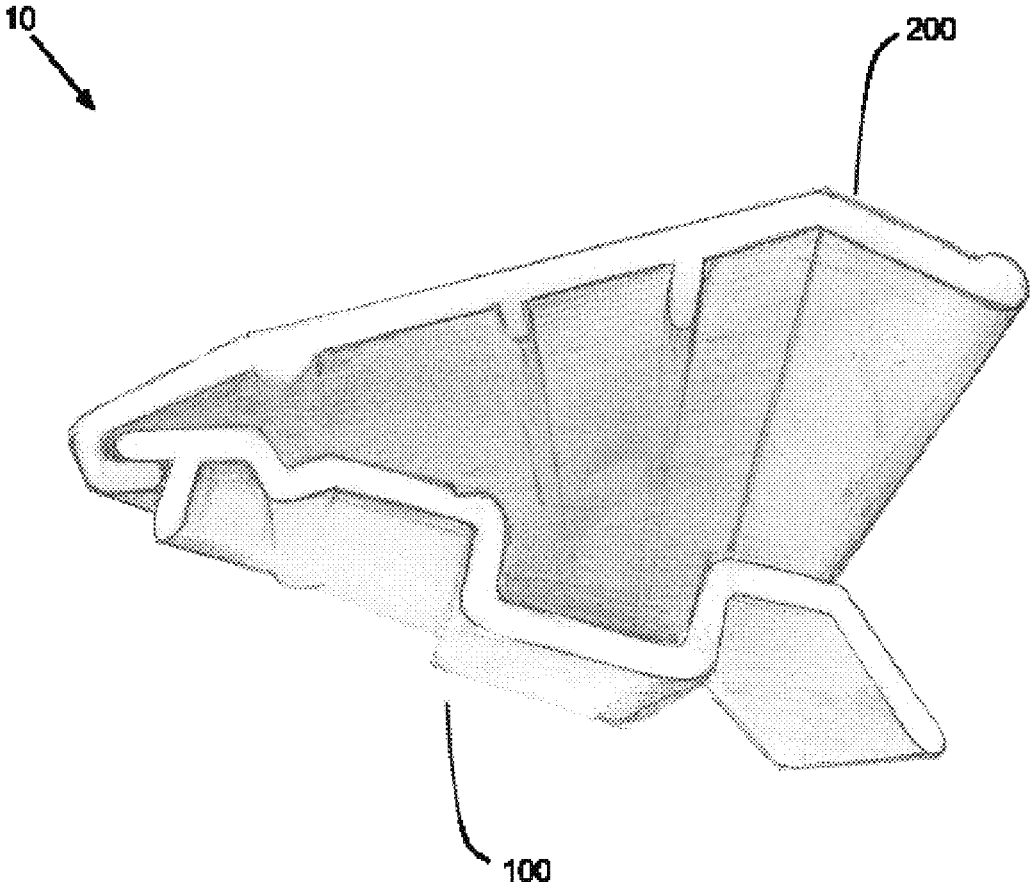
FIG. 1 shows a perspective view of the frame, both the base and cover plate, at a slightly depressed angle from the plane of the frame coupled together.
Figure 5:
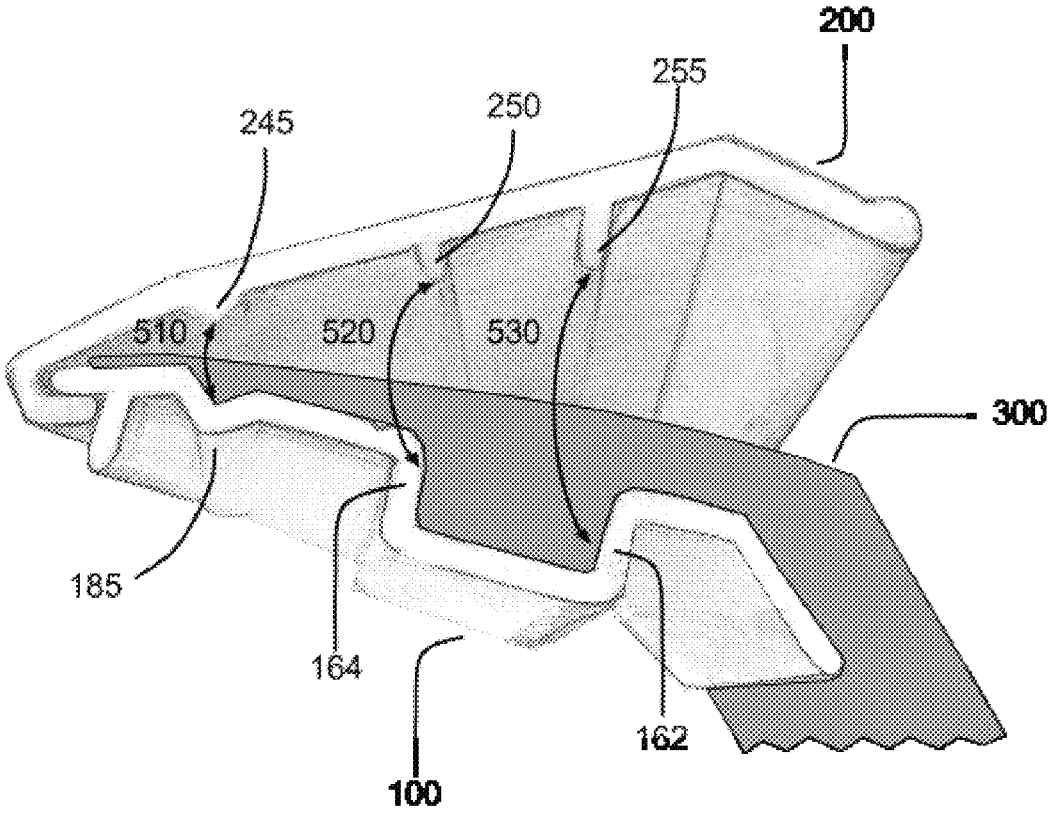
FIG. 5 shows a perspective view of the frame, both the base and cover plate, at a slightly depressed angle from the plane of the frame coupled together with sheet media sandwiched therein.

FIG. 1 shows frame 10 which is comprised of base plate 100 and cover plate 200. FIG. 5 shows base plate 100 and cover plate 200 coupled together but not yet fully mated so as to better show various features that are visible on the lower surface of cover plate 200.

Figure 2:
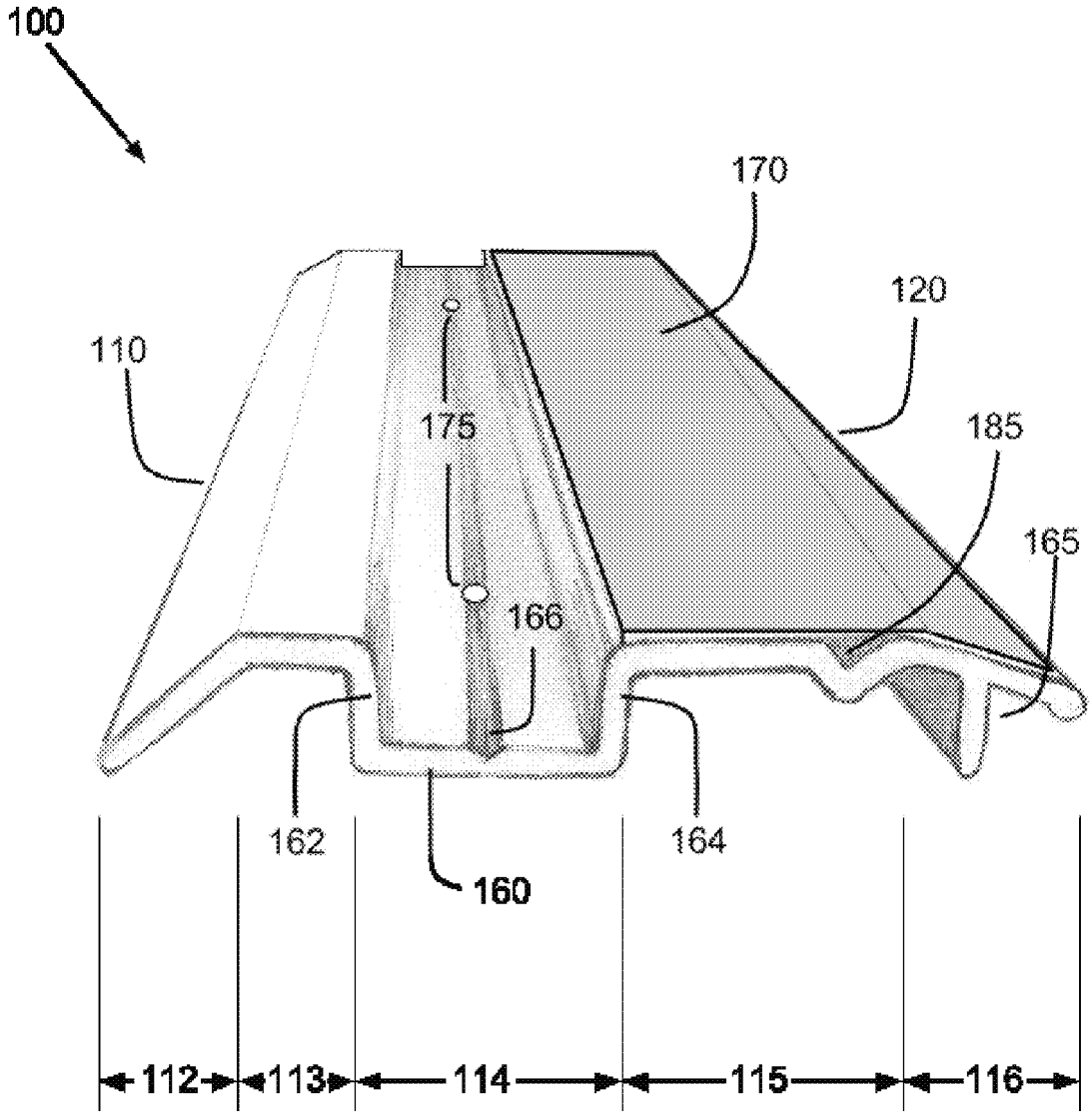
FIG. 2 shows a perspective view of the side of the base plate at a slightly elevated angle from the plane of the base plate so as to better view features on its top surface.
Figure 3:
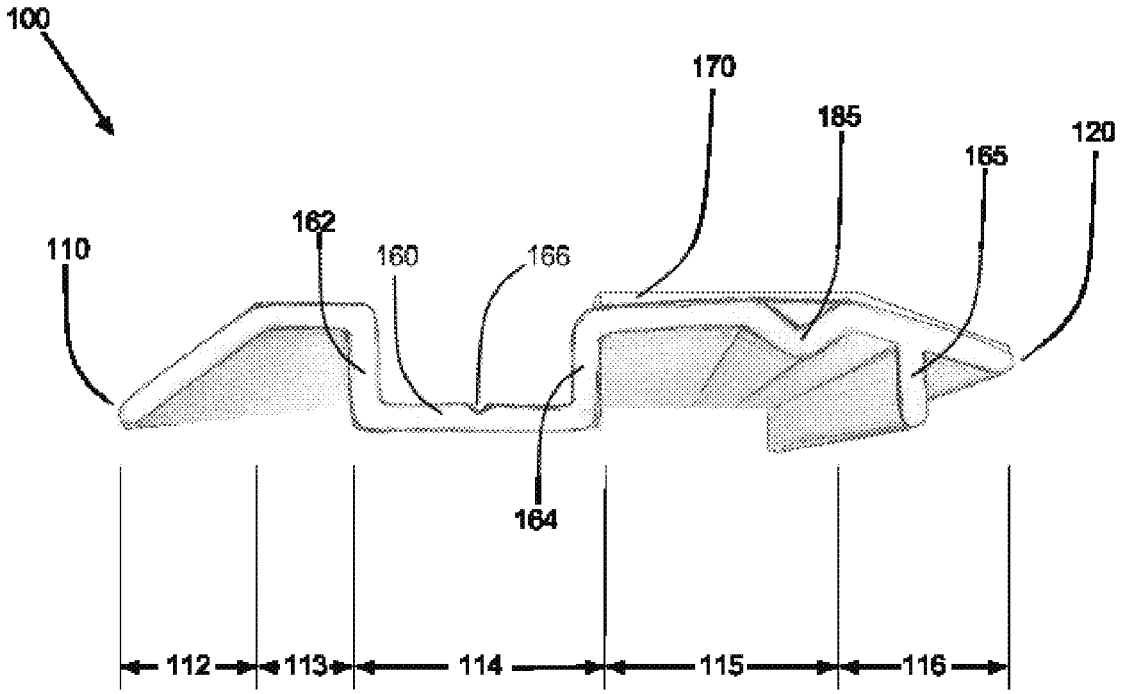
FIG. 3 shows a perspective view of the side of the base plate at a slightly depressed angle from the plane of the base plate so as to better view features on its lower surface.

FIGS. 2 and 3 show different perspective views of base plate 100. FIG. 2 shows a perspective view at an angle slightly above the plane of base plate 100 to better show the features visible on the top surface of base plate 100 while FIG. 3 shows a perspective view at an angle slightly below the plane of base plate 100 to better show the features visible on the bottom surface of base plate 100. Base plate 100 is created from a lightweight metallic alloy of a specific thickness and width with a varying length by an extrusion manufacturing process. Base plate 100 is comprised of first edge 110 and second edge 120 and has a profile that may be divided into five segments 112, 113, 114, 115 and 116.

First segment 112 of base plate 100 has first edge 110 and traverses and across the mounting surface at an angle so that first segment 112 rises above the mounting surface. First segment 112 ends when it abuts second segment 113. First edge 110 does make contact with the mounting surface and in conjunction with other segments that make contact with the mounting surface functions to provide stability to base plate 100 while yet minimizing the surface area of base plate 100 that makes contact with the mounting surface.

Second segment 113 of base plate 100 traverses in parallel to the mounting surface. Second segment 113 ends when it abuts third segment 114. The purpose of second segment 113 is twofold. First is that second segment 113 provides a surface area that is in continuous contact with cover plate 200. Cover plate 200 is mated with base plate 100 using fasteners that operate within this segment. Second is that the space below second segment 113 allows for the use of rivet nuts so that rivet screws may be used to mate cover plate 200 to base plate 100. This extends the useful life of cover plate 200 as machine screws will, over multiple uses, require new screw holes to be drilled negatively affecting the finished look of cover plate 200.

If base plate 100 is to be used for framing sheet media 300 without the benefit of cover plate 200 a secondary embodiment of base plate 100 will properly function without second segment 113. In this configuration the slope of first segment 112 will need to be reduced so as to properly meet third segment 114. In yet another embodiment where base plate 100 is used without the benefit of cover plate 200 adhesive material may be laid upon the top surface of second segment 113 to increase the bonding strength between base plate 100 and sheet media 300. This adhesive material may be covered by a non-stick protective tape liner so as to prevent sheet media from bonding prematurely.

Third segment 114 of base plate 100 is comprised of three elements, a first vertical wall 162, a second vertical wall 164, a base 160 separating first vertical wall 162 and second vertical wall 164. Base 160 is in continuous contact with the mounting surface and is of sufficient width so as to allow fasteners to be used to attach base plate 100 to the mounting surface. On the top surface of base 160 at equidistance from first vertical wall 162 and second vertical wall 164 channel 166 is present and runs the entire length of base 160. Channel 166 provides the installer of base plate 100 a guideline for which to deploy fasteners and assists in preventing machine screw type fasteners from drifting about the base element during drilling. Periodically along channel 166 anchoring holes 175 are present so that base plate 100 may be used as a template to mark the location of fasteners on the mounting surface and allow fasteners to pass through base plate 100 and into the mounting surface. Third segment 114 is abutted on the first side by second segment 113 and on the second side by fourth segment 115.

Fourth segment 115 of base plate 100 traverses across the mounting surface in parallel with the mounting surface until abutting fifth segment 116 of base plate 100. Fourth segment contains 'V' groove 185 that engages 'V' protrusion 245 on cover plate 200 when cover plate 200 is mated with base plate 100. If base plate 100 is to be used for framing sheet media 300 without the benefit of cover plate 200 a secondary embodiment of base plate 100 does not require the presence of 'V' groove 185. The purpose of 'V' groove 185 and 'V' protrusion 245 are described in greater detail when discussing FIG. 5.

Fifth segment 116 abuts fourth segment 115 on its first side and terminates at second edge 120. Fifth segment 116 angles towards mounting surface while transversing over the mounting surface. However the slope and width of fifth segment 116 are small enough so that second edge 120 does not make contact with the mounting surface and to maintain a small gap between second edge 120 and the mounting surface so that contour 260 may fit within the gap. Additionally, in the preferred embodiment, support leg 165 extends from the lower surface of fifth segment 116 and is of such height to make contact with mounting surface. Support leg 165, along with first edge 110 and base 160 of third segment 114, allow for a triad of points to make contact with the mounting surface and increase the stability of base plate 100 when it has been attached to the mounting surface. A secondary embodiment may be envisioned where support leg 165 is not present. Although this will reduce the stability of base plate 100, base plate 100 will continue to properly function.

Finally over fourth segment 115 and fifth segment 116 a adhesive material 170 is applied. Adhesive material 170 has sufficient bonding strength to support sheet media 300 for a set period of time and under mild weather conditions. Additionally adhesive material 170 is such that sheet media 300 may be removed and reattached multiple times prior to any degradation of bonding strength to a point that adhesive material 170 will lack the bonding strength to support sheet media 300. When adhesive material 170 lacks the necessary bonding strength it may be removed from base plate 100 by any number of means and replaced. If base plate 100 is used without the benefit of cover plate 200 adhesive material 170 provides the only means to support sheet media 300. When base plate 100 is used with the benefit of cover plate 200 adhesive material 170 is only required to support sheet media 300 until cover plate 200 is attached to base plate 100. Adhesive material 170 may be covered by a non-stick protective tape liner so as to prevent sheet media 300 from bonding with adhesive material 170 prematurely.

Figure 4:
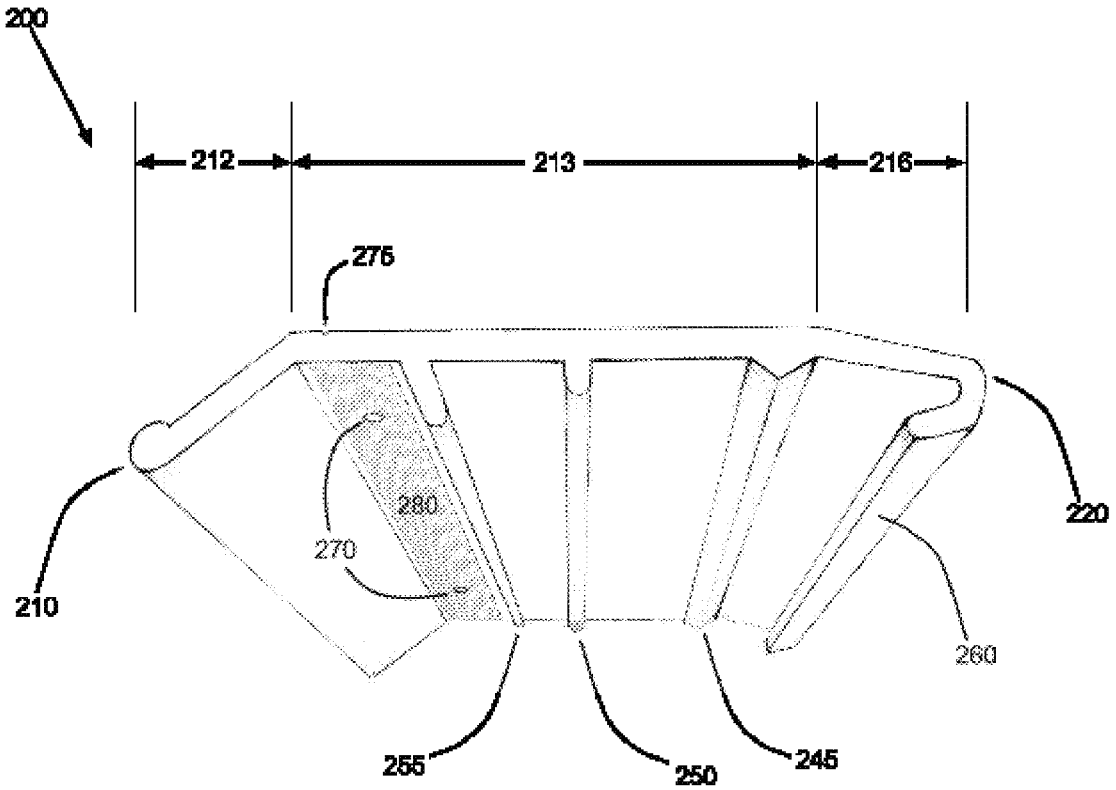
FIG. 4 shows a perspective view of the side of the cover plate at a slightly depressed angle from the plane of the cover plate so as to better view features on its lower surface.

FIG. 4 show a perspective view of cover plate 200 at an angle slightly below the plane of cover plate 200 to better show the features visible on the bottom surface of cover plate 200. Cover plate 200 is created from a lightweight metallic alloy of a specific thickness and width with a varying length by an extrusion manufacturing process. Cover plate 200 is comprised of first edge 210 and second edge 220 and has a profile that may be divided into three segments 212, 213, and 214.

First segment 212 of cover plate 200 has first edge 210 and traverses across the mounting surface at an angle so that first segment 212 rises above the mounting surface. First segment 212 ends when it abuts second segment 213. The angle and width of first segment 212 are such that when cover plate 200 is mated with base plate 100 it will match with first segment 112 of base plate 100. First edge 210 of cover plate 200 does not make contact with the mounting surface.

Second segment 213 of cover plate 200 abuts first segment 212 and traverses across the mounting surface in parallel with the mounting surface. The width of second segment 213 is such that when cover plate 200 is mated with base plate 100 it will match the combined widths of base plate 100 segments 113, 114, and 115. The bottom surface of second segment 213 has multiple features.

The first feature on the bottom surface of second segment 213 are grip serrations 280. Grip serrations are thin raised lines comprise of the same material used to construct cover plate 200. The serrations are spaced apart so as to create a rough surface. The combined width between serrations match the width of second segment 113 of base plate 100 so that when cover plate 200 is mated with base plate 100 the serrations will press on sheet media 300 and clamp sheet media 300 to second segment 113 of base plate 100. This will provide a uniform clamping force across the entire length of frame 10 increasing the life of the sheet media when it is exposed to high winds as when frame 10 is attached to the side of truck trailers.

The second feature on the bottom surface of second segment 213 are screw holes 270. A plurality of screw holes 270 are periodically drilled into cover plate 200 to allow screws to pass through cover plate 200, sheet media 300, and second segment 113 of base plate 100. Screw holes 270 minimize the common installer error of using too few screws or using them at irregular intervals.

The third feature on the bottom surface of second segment 213 is tensioning leg 255 which operates in conjunction with the fourth feature on the bottom surface of second segment 213, pretensioning leg 250. Although explained in greater detail when discussing FIG. 5, pretensioning leg 250 and tensioning leg 255 function to tuck sheet media 300 material into the space provided by third segment 114 of base plate 100 as cover plate 200 is mated with base plate 100. Tensioning leg 255 is located so as to come down next to first vertical wall 162 within base plate 100 third segment 114 as shown on FIG. 5. Pretensioning leg 250 is located so as to come down next to second vertical wall 164 within base plate 100 third segment 114 as shown on FIG. 5.

The fifth and final feature on the bottom surface of second segment 213 is 'V' protrusion 245. 'V' protrusion 245 runs the entire length of cover plate 200 and is located so as to mate with 'V' groove 185 on base plate 100. 'V' protrusion 245 and 'V' groove 185 operate in conjunction with each other to clamp sheet media 300 when cover plate 200 is mated with base plate 100. Clamping sheet media 300 at a point prior to the engagement of pretensioning leg 250 will ensure that pretensioning leg 250 will draw sheet media material that is bounded by frame 10 into third segment 114 of base plate 100.

FIG. 5 shows frame 10 which is comprised of base plate 100 and cover plate 200. FIG. 5 shows base plate 100 and cover plate 200 coupled together but not yet fully mated so as to better show how sheet media 300 is tensioned by the simple act of mating base plate 100 and cover plate 200 together. This will be described in the following paragraphs discussing the steps to mount frame 10 to a mounting surface and subsequently sheet media 300.

Prior to mating base plate 100 and cover plate 200 an arrangement of two or more base plates 100 that fully or partially define the perimeter of the display is fastened to the mounting surface that is to be a foundation for the display.

Next after the base plates 100 have been fastened to the mounting surface the non-stick protective tape liner covering adhesive strip 170 will be removed and sheet media 300 will be hand stretched and pressed against the exposed adhesive surface of adhesive strip 170. The bonding strength of adhesive strip 170 is such that sheet media 300 will be held in place absent high wind or wet weather conditions.

After sheet media 300 is secured by adhesive strip 170 any excess sheet media 300 material extending beyond second edge 120 of base plate 100 may be trimmed using second edge 120 of base plate 100 as a guide.

At this point cover plate 200 may be applied to base plate 100 by engaging contour 260 over second edge 120 of base plate 100 as shown both in FIG. 1 and FIG. 5. As cover plate 200 begins to come into contact with base plate 100, 'V' protrusion 245 will press against sheet media 300 held by adhesive strip 170 until sheet media 300 is firmly held within 'V' groove 185. Clamping of sheet media 300 will allow pretension leg 250 and tensioning leg 255 to draw sheet media 300 from within frame 10. This is shown in FIG. 5 by movement 510.

As cover plate 200 continues to engage base plate 100 pretension leg 250 will come into contact with sheet media 300 and tuck sheet media 300 into third segment 114 base plate 100. This is shown in FIG. 5 by movement 520. As sheet media 300 is pinned by 'V' protrusion 245 and 'V' groove 185 movement of sheet media 300 caused by pretension leg 250 will be from the display area of sheet media 300 as opposed to the edge of sheet media 300.

As cover plate 200 continues to engage base plate 100 tensioning leg 255 will come into contact with sheet media 300 and further tuck sheet media 300 into third segment 114 base plate 100 as shown in FIG. 5 by movement 530. As the media sheet 300 is already pinned by the engagement of 'V' teeth and 'V' groove and pretensioning leg 250 movement of sheet media 300 caused by tensioning leg 255 will be from the display area of sheet media 300 as opposed to the edge of sheet media 300. After cover plate 200 and base plate 100 have fully engaged the amount of tension added to sheet media 300 is determined by the summation of the height of pretensioning leg 250 and tensioning leg 255. The longer the legs the greater the tensioning effect. As sheet media 300 had already been hand taut earlier the amount of tensioning required to complete the tensioning process is sufficiently provided by the lengths of pretensioning leg 250 and tensioning leg 255.

Cover plate 200 is then attached to base plate 100 using self drilling or self tapping screws that through various means pierce through second segment 213 of cover plate 200, sheet media 300, and second segment 113 of base plate 100. A second embodiment of base plate 100 will allow rivet nuts to be attached to the lower surface of second segment 113 of base plate 100 that will correspond to cover plate 200 screw holes 270 so that base plate 100 may be reused multiple times with no loss of fastening strength due to reuse of machine screws.

The invention claimed is:

1. A self tensioning frame for mounting media prints on an existing surface comprising at least one pair of parallel said frames that attach to said surface where said frame is comprised of a base plate and a cover plate both of unibody construction, with a certain width and length, said base plate containing a profile comprising:

a first segment angled away from said surface with edge contacting said surface and boundary abutting second segment;

said second segment traversing in parallel to said surface and abutting a third segment;

said third segment comprising two vertical elements and a base element such that said base element is in continuous contact with said surface and joins at the bottom of said two vertical elements with top of first vertical element abutting said second segment and top of second vertical element abutting a fourth segment;

said fourth segment traversing in parallel to said surface containing a groove traversing longitudinally therein and abutting a fifth segment; and said fifth segment angled towards said surface with edge approaching but not contacting said surface further comprising a support leg traversing lengthwise and within said edge and in contact with said surface ensuring a gap between said edge and said surface; and said cover plate containing a profile comprising:

a first segment that is of substantially similar width and angle of said first segment of said base plate and abuts a second segment;

said second segment traversing in parallel to said surface of a width substantially similar to the summation of the widths of said second, third, and fourth segments of said base plate with first tensioning leg positioned to engage said first vertical element of said second segment of said base plate and second tensioning leg positioned to engage said second vertical element of said second segment of said base plate and a protrusion to engage said groove of said fourth segment of said base plate and abuts a third segment; and said third segment that is of substantially similar length and angle of said fifth segment of said base plate and an edge with a contour so as to allow said cover plate to be supported by said base plate.

2. The frame of claim 1 wherein said base element contains a plurality of holes for the purpose of allowing the passage of a fastener device to said surface and to serve as a template for the same.

3. The frame of claim 1 wherein two pairs of said frames are attached to said surface to mount said media print on all four edges of said media print.

4. The base plate of claim 1 wherein an adhesive material affixed to the upper surface of said fourth and fifth segments to secure said media print.

5. A self tensioning frame for mounting media prints on an existing surface comprising at least one pair of parallel said frames that attach to said surface where said frame is comprised of a base plate attached to said surface and a cover plate above said base plate both of unibody construction, with a certain width and length, having an inner edge, an outer edge, an upper surface, and a lower surface with said media print held between said plates; said base plate containing a profile comprising:

a groove transversing the length of the upper surface of said base plate proximally located to its outer edge; and a 'U' channel with a first wall, second wall, and base transversing the length of the upper surface of said base plate and in contact with said surface and located between said groove and said inner edge;

said cover plate containing a profile comprising:

an outer edge in the shape of a contour;

a protrusion transversing the length of the lower surface of said cover plate proximally located to its outer edge so as to engage with said groove on said base plate; and a first leg and second leg transversing the length of the lower surface of said cover plate between said protrusion and said inner edge so as to engage with said first wall and said second wall on said base plate;

said cover plate engaging said base plate in the following sequence of actions:

a first action being said contour engaging with said outer edge of said base plate;

a second action being said protrusion engaging said groove and clamping media print to prevent the following actions from drawing media print from outside the boundary of said frame;

a third action being said first leg engaging with said first wall drawing media print from inside the boundary of said frame into said 'U' channel; and a fourth action being said second leg engaging with said second wall further drawing media print from inside the boundary of said frame into said 'U' channel.

* * * * *